US006006400A

United States Patent [19]

Presenza

[11] Patent Number: 6,006,400

[45] Date of Patent: Dec. 28, 1999

[54] ELECTRIC BACKPACK BLOWER

[76] Inventor: Tom Presenza, 4513 N. O'Connor, Suite 1131, Irving, Tex. 75062

[21] Appl. No.: 08/905,689

[22] Filed: Aug. 4, 1997

Related U.S. Application Data

[63] Continuation-in-part of application No. 08/607,099, Feb. 26, 1996, abandoned.

[51] Int. Cl.[6] ..... A47L 5/14

[52] U.S. Cl. ..... 15/327.5; 15/405; 15/DIG. 1; 417/234; 417/423.15

[58] Field of Search ..... 15/327.5, 405, 15/DIG. 1; 417/234, 423.15; 416/244 R, 244 A

[56] References Cited

U.S. PATENT DOCUMENTS

| | | | |
|---|---|---|---|
| 3,267,510 | 8/1966 | Cote | 15/344 |
| 3,286,446 | 11/1966 | Happe et al. | 15/327.5 X |
| 3,331,090 | 7/1967 | Reiber et al. | 15/327.5 X |
| 4,325,162 | 4/1982 | Chambers et al. | 15/327.5 |
| 4,483,070 | 11/1984 | Junkerman et al. . | |
| 4,643,776 | 2/1987 | Hollowell et al. . | |
| 4,748,712 | 6/1988 | DiGiovanni | 15/327.5 |
| 5,011,058 | 4/1991 | Sapp et al. | 15/327.5 |
| 5,014,388 | 5/1991 | Schiazza et al. | 15/DIG. 1 |
| 5,020,186 | 6/1991 | Lessig et al. | 15/DIG. 1 |
| 5,134,752 | 8/1992 | Shipman | 15/DIG. 1 |
| 5,195,208 | 3/1993 | Yamami et al. . | |
| 5,241,932 | 9/1993 | Everts et al. . | |
| 5,267,321 | 11/1993 | Soler et al. . | |
| 5,813,088 | 9/1998 | Wagner et al. | 15/327.5 |

*Primary Examiner*—Chris K. Moore
*Attorney, Agent, or Firm*—David H. Judson

[57] ABSTRACT

A battery powered, back-pack blower comprising a mounting frame, a horizontally mounted impeller oscillated by an electric motor powered by a battery pack. The impeller and motor are positioned on the mounting frame above the battery back to better distribute the weight. The electric motor reduces the level of noise and smoke emissions from blowers using internal combustion engines. A U-bracket serves to horizontally mount the electric motor which allows for greater heat dissipation from the motor and also aids in dismantling the blower.

8 Claims, 3 Drawing Sheets

ELECTRIC BACKPACK BLOWER

This is a continuation-in-part of application Ser. No. 08/607,099 filed on Feb. 26, 1996 now abandoned.

TECHNICAL FIELD

The present invention relates to a blower which is mounted on a backpack. The blower uses a battery-powered electric motor to reduce noise, emissions, and weight.

BACKGROUND OF THE INVENTION

Backpack mounted blowers are traditionally powered by gasoline engines which generate considerable smoke and noise emissions. The noise emissions from the internal combustion engines use in leaf blowers have caused considerable distress to many communities in the United States. Some of these communities have banned or restricted the use of leaf blowers based on these emissions. Therefore, it is advantageous to design a blower that can reduce both noise and smoke emissions. It is known in the art to produce a backpack mounted blower having an internal combustion motor with various forms of insulation to reduce the noise emission. One such apparatus is U.S. Pat. No. 5,195,208. Although such techniques are used, it has not been possible to produce a quiet efficient blower with lessened smoke emissions that is easy to carry.

BRIEF SUMMARY OF THE INVENTION

The object of the present invention is to provide a sufficiently-powered backpack blower that can reduce the disadvantages enumerated above. It is also an object of the present invention to provide a backpack blower which is powered by an electric motor with low noise emissions that is also sufficiently lightweight to be portable.

It is another purpose of this invention to establish an electric motor assembly that is horizontally end mounted that allows easy access to the motor as well as placing the circuit board in a convenient location for replacement.

The present invention uses a battery powered electric motor to reduce noise and other emissions. In its preferred embodiment, the parts comprising the back pack power blower are situated so that the weight is well distributed. Instead of the bulky cube form used in traditional backpack blowers, the present invention has component parts which are distributed on the mounting frame so as to place the majority of the load on the user's hips rather than on the shoulders, thereby allowing greater productivity due to a lesser burden on the shoulders.

DETAILED DESCRIPTION AND PREFERRED EMBODIMENT

Figure 1:
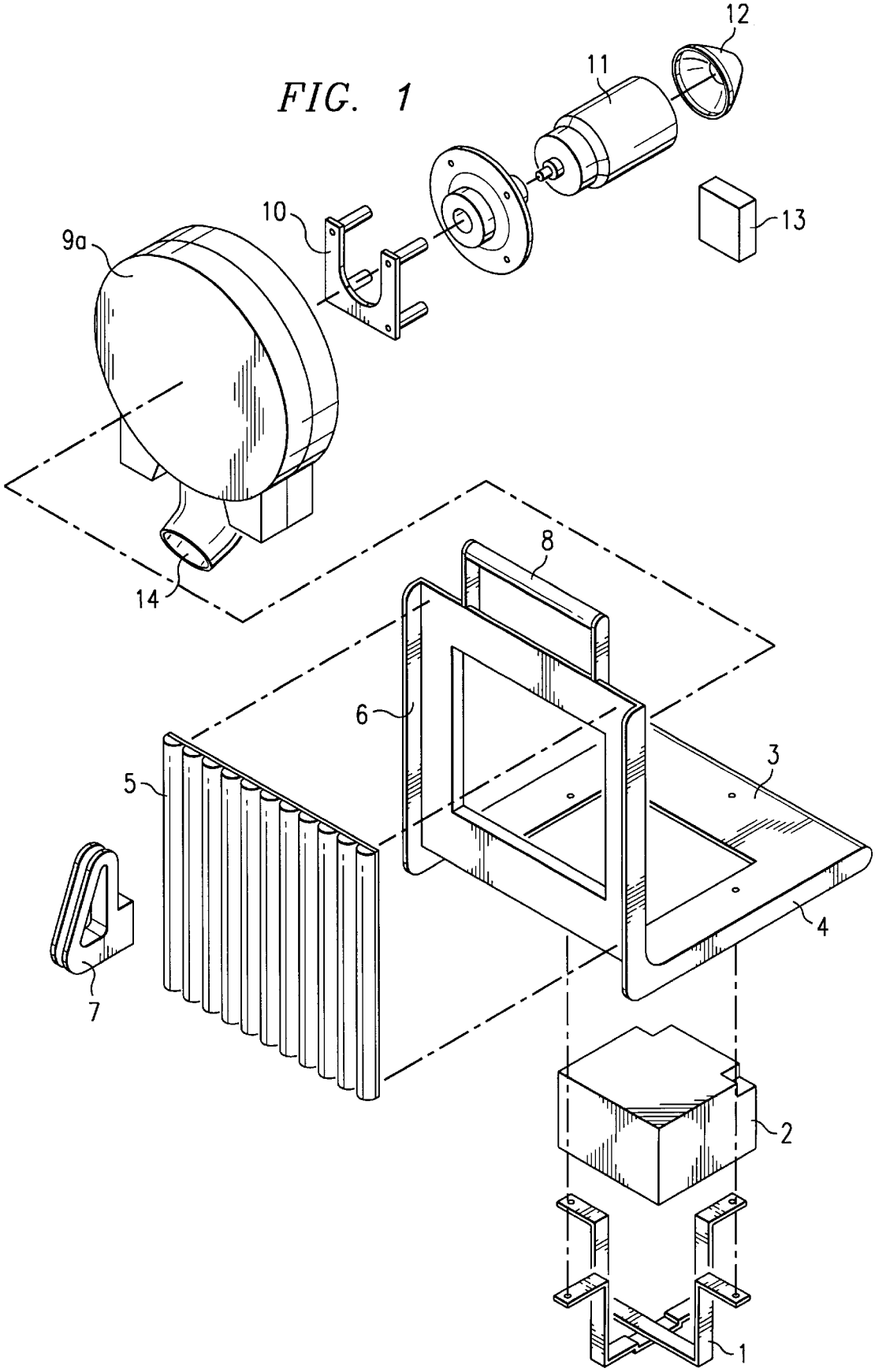
FIG. 1 is a side view of the impeller and backpack frame system.
Figure 1A:
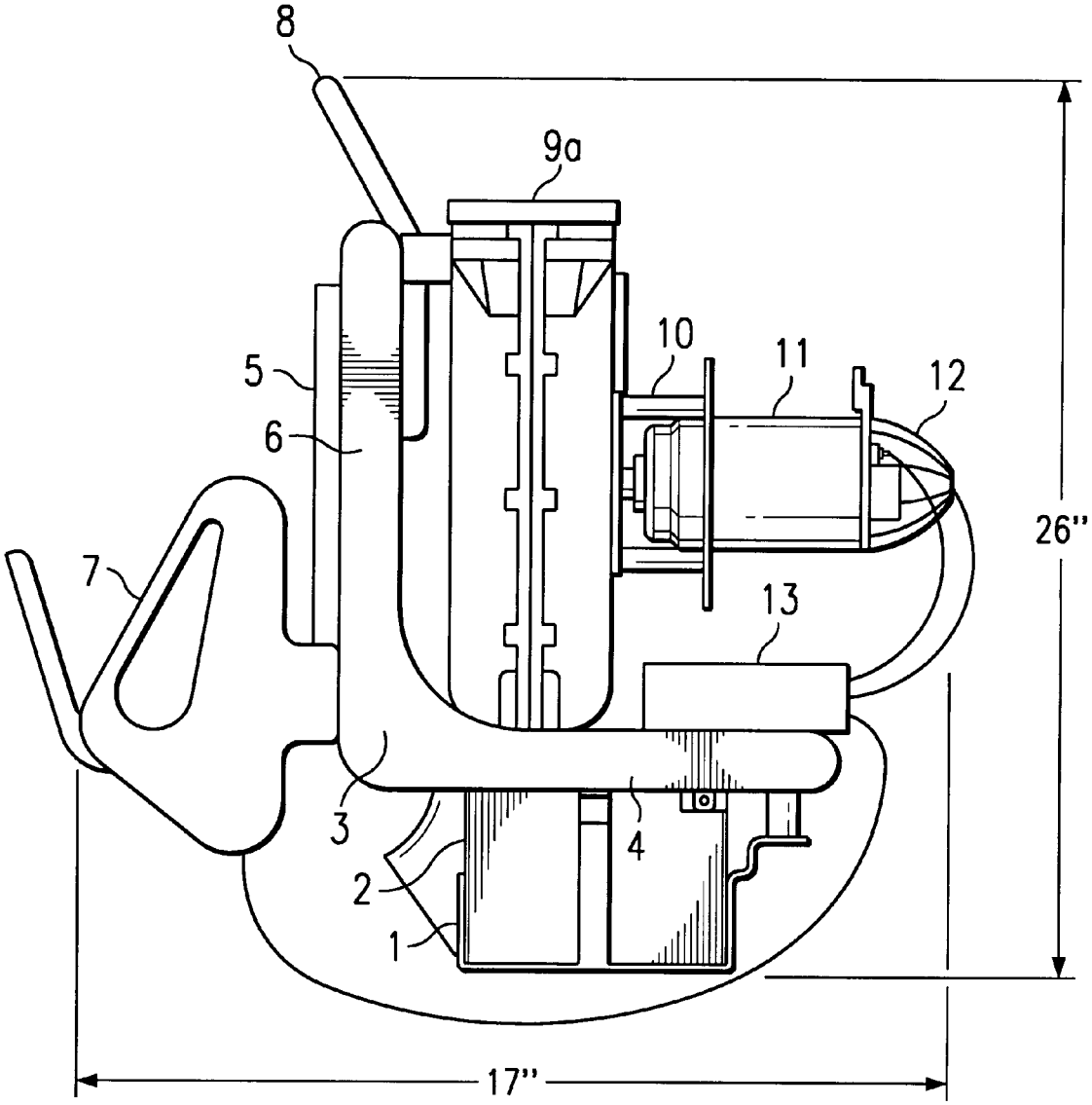
Figure 2:
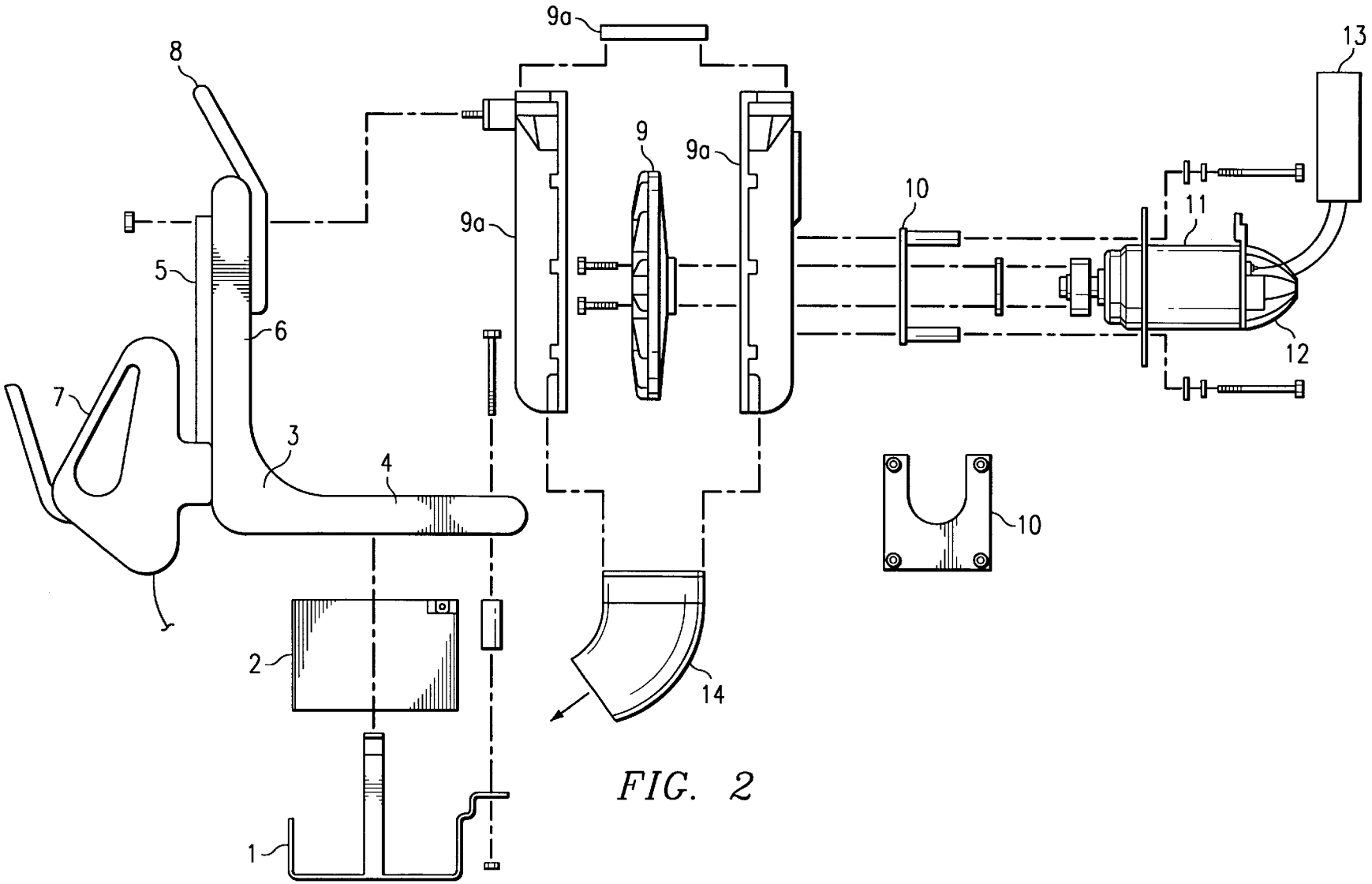
FIG. 2 is an assembly view of the backpack blower.

The backpack blower has an L-shaped mounting frame 3 with a rechargeable battery 2 clamped to the bottom horizontal side 4 of the frame using a clamp set 1. Referring simultaneously to FIGS. 1 and 2, the mounting frame has a front vertical side 6 to be carried on the back of the user. Sponge cushioning 5 is attached to the front vertical side 6 to support as well as insulate the back of the user from the blower apparatus. A handle 8 is attached to the front side for ease in moving the assembly. Shoulder straps, not in FIG. 1, on both sides of the front horizontal section secure the user to the frame. A starter/deadman's switch 7 is on the front horizontal side to start the blower and immediately disengage the blower when not in use. The starter functions by merely pressing the lever downwards. The engine disengages when the lever is released.

The impeller 9 enclosed in housing 9*a* is attached to the top of the vertical section of the mounting frame. A U-bracket 10 is mounted to impeller housing 9*a*. The U-bracket serves as the motor mount for the horizontally attached electric motor 11. The U-bracket, in this preferred embodiment, contain four prongs. In its preferred embodiment, the U is facing upward. Two of the prongs bracket the edges on the curve of the U, while the other two prongs are placed on the tips of the vertical segments of the U. These prongs extend from the impeller housing 9*a* to horizontally support the electric motor. This mode of motor-mounting allows additional heat dissipation since the cylinder is completely exposed to the air to allow for free convection. In the preferred embodiment, there will be air currents emitted from the impeller that will allow for forced convection over the length of the motor. The traditional use of an engine mount upon the cylindrical sides forces the area contacting the mount to rely on heat conduction from the electric motor through the motor mount which has the disadvantage of heating another solid segment of the assembly as well as lessening the heat transfer from the electric motor. Another advantage of the U-bracket/electric motor/impeller assembly is that it can be removed from the frame by only disengaging the impeller whereas the use of a cylindrical side mount forces the user to disengage both the impeller and motor separately in order to remove the motor/impeller assembly.

The electric motor itself provides the advantages of cutting down on the noise and smoke emissions that are traditionally emitted from internal combustion engines. Air cooling vents 12 are attached to the end of the electric motor. A circuit board 13 to control the electric motor is attached underneath the vents. The circuit board contains a cut-off switch (not shown) which prevents the motor from being started by the starter switch. Due to the ease of starting the blower from the starter switch, the cut-off switch connected to the circuit board provides an additional safety feature. The blower output 14 is on the right side of the impeller. A hose to guide the air and increase the velocity is attached to the blower output and is not shown in FIG. 1.

It should be understood, of course, that while the invention herein shown and described constitutes a preferred embodiment of the invention, it is not intended to illustrate all possible variations thereof. Alternative structures may be created by one of ordinary skill in the art without departing from the spirit and scope of the invention described in the following claims.

I claim:

1. A backpack blower apparatus, comprising:

a frame for carrying an impeller, a blower and associated parts, said frame including a front portion to be carried on the back of an operator;

an impeller housing attached to the frame;

an impeller mounted behind the front portion of the frame inside the impeller housing, an electric motor, means for horizontally end-mounting the electric motor to the impeller housing so that the shaft of the motor engages the impeller, a control means for engaging and disengaging power to the electric motor, a battery for powering the electric motor attached to the frame, and a circuit board attached to the electric motor.

2. The backpack blower in claim 1 wherein the frame is an L frame, said frame including a front vertical portion to be carried on the back of an operator and a bottom horizontal portion.

3. The backpack blower in claim 1 wherein the means for mounting the electric motor to the impeller housing is a U-bracket with attachment means to the motor.

4. The U-bracket in claim 3 wherein the attachment means are a number of prongs which connect to the motor.

5. The backpack blower in claim 1 wherein the control means for engaging and disengaging the power to the electric motor is a starter/deadman's switch.

6. The backpack blower in claim 1 wherein the battery for powering the electric motor is a rechargeable battery.

7. A motor and impeller assembly, comprising:

an impeller, an electric motor, and a U-Bracket with attachment means to the electric motor for horizontally end-mounting the electric motor to a support member such that the shaft of the electric motor engages the impeller, a connection for attaching a battery to the electric motor, and a circuit board attached to the electric motor.

8. The U-bracket in claim 7 wherein the attachment means are a number of prongs which connect to the electric motor.

* * * * *